United States Patent [19]

Matsukawa et al.

[11] 3,952,129

[45] Apr. 20, 1976

[54] COATED PRESSURE SENSITIVE COPYING PAPER

[75] Inventors: Hiroharu Matsukawa; Takao Hayashi, both of Fujimiya, Japan

[73] Assignee: Fuji Photo Film Co., Ltd., Minami-ashigara, Japan

[22] Filed: Dec. 17, 1973

[21] Appl. No.: 425,660

Related U.S. Application Data

[62] Division of Ser. No. 187,244, Oct. 7, 1971, abandoned.

[30] Foreign Application Priority Data

Oct. 7, 1970 Japan ..... 45-88137

[52] U.S. Cl. ..... 428/323; 106/21; 427/145; 428/150; 427/325

[51] Int. Cl.[2] ..... B41M 5/12; B41M 5/16; B41M 5/22

[58] Field of Search ..... 117/36.2; 106/21, 22; 8/165, 79; 428/323, 325; 427/150, 145

[56] References Cited

UNITED STATES PATENTS

| | | | |
|---|---|---|---|
| 2,546,167 | 3/1951 | Salvin et al. | 8/165 |
| 2,567,130 | 9/1951 | Smith | 8/165 |
| 2,666,790 | 1/1954 | Williams et al. | 8/165 |
| 2,691,565 | 10/1954 | Berardinelli et al. | 8/165 |
| 2,764,467 | 9/1956 | Salvin et al. | 8/165 |
| 3,536,517 | 10/1970 | Van Der Heuvel et al. | 117/36.2 |
| 3,773,542 | 11/1973 | Hayashi et al. | 117/36.2 |

*Primary Examiner*—Thomas J. Herbert, Jr.
*Attorney, Agent, or Firm*—Sughrue, Rothwell, Mion, Zinn & Macpeak

[57] ABSTRACT

A color-forming composition and recording sheets embodying the composition are disclosed, wherein the color-forming composition comprises: (a) a leuco dye, (b) an aromatic secondary amine or derivative thereof and (c) an organic solvent.

6 Claims, 8 Drawing Figures

COATED PRESSURE SENSITIVE COPYING PAPER

This application is a divisional application of Ser. No. 187,244, filed Oct. 7, 1971, now abandoned.

BACKGROUND OF THE INVENTION

Field of the Invention

This invention relates to a color-forming composition. More specifically, it relates to a color-forming composition comprising a leuco dye, an aromatic amine or its derivative and an organic solvent.

The primary object of this invention is to provide a colorforming composition which gives a color of improved fastness and excellent discoloration resistance, upon contact of a leuco dye contained therein (which will be referred to as a "color former") with a color developer. The above object is attained by using an aromatic amine or its derivative as one component of the color-forming composition.

Description of the Prior Art

Many instances of application of color-forming reactions between color formers and color developers to recording methods have been known.

For instance, there are adopted methods comprising transferring a solution of a color former to a color developer sheet, and a method comprising coating a color former solution with a wall of a high molecular weight substance, rupturing the resulting microcapsules on a color developer sheet and thus transferring the solution to the color developer sheet. Many forms of both reactants have been proposed and are known in the art. For instance, there may be mentioned a recording sheet prepared by dispersing a solution of a color former in a binder and coating the dispersion on ordinary base paper or a color developer sheet, a recording sheet prepared by coating microcapsules such as described above onto base paper or a color developer sheet (the so-called pressure-sensitive recording or copying paper), or a printing method comprising feeding a color former solution in the form of an ink composition to a color developer sheet through a stencil. These proposals are in common with one another in the point that both the color former and color developer are used, though they differ in the manner of using these reactants.

Examples of the color former include triarylmethane compounds, diphenylmethane compounds, xanthene compounds, thiazine compounds and spiropyrane compounds.

The color developers include, for example, clay minerals such as acid clay, activated clay, attapulgite, zeolite or bentonite; organic acids such as tannic acid or gallic acid; and phenol resins.

These agents are specifically disclosed, for instance, in U.S. Pat. No. 2,505,489, U.S. Pat. No. 2,548,366, U.S. Pat. No. 2,730,456, U.S. Pat. No. 2,730,457, and laid-open Specification of German Patent Application No. 1,919,397.

In general, colors formed by the reaction between the above two reactants (color former and color developer) are very inferior in fastness to those produced by ordinary pigments. This tendency is especially outstanding when the resulting colors are exposed to sunlight or fluorescent light. The fastness of colors depends on the structure of the color former, and varies greatly according to it. Colors formed by certain color formers degrade under the influence of light and color hues are changed. Many color formers useful for the above-mentioned recording methods are included within this type.

The difference among individual color formers with respect to the color fastness, or the absence or presence of degradation in formed colors brings about a great disadvantage in colored images of blue, blue black, green and black colors, especially colored images of black, because colors of images are easily degraded with the lapse of time or under irradiation of light, exhibiting a very low color fastness.

Among color formers used for forming a color hue comprising a blue color component, such as blue, blue black and green, most of the blue-color-forming compounds other than the thiazine compounds do not give a color fastness sufficient for practical use. Accordingly, when colors formed by employing such color formers are allowed to stand indoors or exposed to sunlight, the color density is readily lowered or the initial color hue changes readily, with the result that the color intensity is reduced.

For instance, a combination of Crystal Violet Lactone and benzoyl leucomethylene blue is mainly used for forming a blue color. However, since Crystal Violet Lactone is much inferior in resistance to light, the color formed easily disappears when allowed to stand indoors or exposed to light, with the result that the once formed color is changed into a color derived only from benzoyl leucomethylene blue (light blue) and the commercial value of the colored image is therefore extremely lowered.

The fluoran compounds proposed in the specification of U.S. Pat. No. 3,501,331 are used as color formers for black, green and blue black colors. Although these compounds form a bluish green color upon contact with color developers, the formed color changes to red when the colored image is allowed to stand indoors or exposed to sunlight. Accordingly, black, green and blue black colors formed by employing such fluoran compounds become reddish when allowed to stand indoors or exposed to sunlight, and therefore, the use of such compounds can not be free from disadvantages such as the change in color hue and the reduction of color fastness.

The fluoran compounds disclosed in the specification of British Pat. No. 1,168,455 are used as color formers for a red color. However, the fastness of colors formed by employing such compounds is inferior to the color fastness obtained by using thiazine compounds, and the light resistance of these fluoran compounds has been required to be improved.

Various attempts have been made with a view to producing color formers free of the above-mentioned defect. The present inventors have made investigations to overcome these defects from a view-point quite different from that of the conventional art.

SUMMARY OF THE INVENTION

An object of this invention is to improve the fastness of colors formed by the contact reaction between color formers and color developers.

Another object of this invention is to reduce the change of color hue in colors formed by the contact reaction between color formers and color developers.

Still another object of this invention is to improve the fastness of images formed by a recording or copying method utilizing the contact reaction between color formers and color developers, and to increase the commercial value of these images by preventing occurrence of change of color hues in these images.

In accordance with this invention, these objects are attained by a color-forming composition comprising a solution of a color former in an organic solvent and, incorporated therein, an aromatic amine or its derivative, especially aromatic secondary amines.

More particularly, aromatic compounds having at least one secondary amino group connected to an aromatic nuclei such as phenylenediamines or phenylamines are preferred.

DESCRIPTION OF THE PREFERRED EMBODIMENTS

Figure 1:
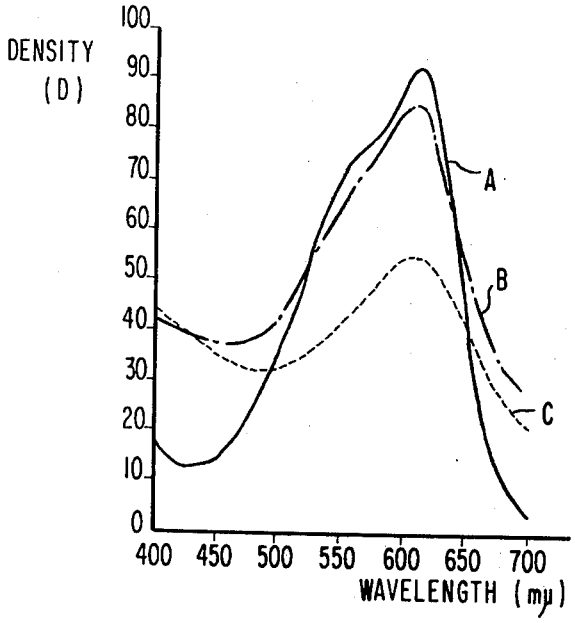
FIGS. 1, 3, 5 and 7 illustrate curves of the colors formed using the capsule sheets obtained in Examples 1, 2, 3 and 4, respectively.

As the aromatic amine or its derivative to be used in this invention, there may be exemplified N,N'-diphenyl-p-phenylenediamine, N-phenyl-N'-cyclohexyl-p-phenylenediamine, N-phenyl-N'-isopropyl-p-phenylenediamine, N,N'-disec-butyl-p-phenylenediamine, N,N'-di-beta-naphthyl-p-phylenediamine, N,N'-bis(1,4-dimethylpentyl)-p-phenylenediamine, N,N'-bis(1-ethyl-3-methylpentyl)-p-phenylenediamine, N-(1-methylpropyl)-N'-phenyl-p-phenylenediamine, N,N'-diphenylamine, p-isopropoxydi-phenyl-amine, phenyl-alpha-naphthylamine, phenyl-beta-naphthylamine, a reaction product of acetone with phenyl-beta-naphthylamine, N,N'-diphenylbenzidine, p-methoxyacetoanilide, hydrazobenzene and N-phenyl-m-anisidine.

Preferred amounts of these aromatic amines or aromatic amine derivatives are 10 – 500% by weight, especially 50 – 200% by weight, based on the weight of the color former. These aromatic amines or aromatic amine derivatives may be used either singly or in combination.

Addition of such aromatic amine or its derivative is performed, in the case of a colorless, color-forming ink, by incorporating it directly into a solution of a color former in an organic solvent, and when a pressure-sensitive recording paper is intended, the aromatic amine or its derivative is dissolved in a solution of a color former in an organic solvent, followed by the steps of forming microcapsules of the resulting solution and coating them onto a support.

Further, a method comprising forming microcapsules of a solution of an aromatic amine or its derivative in an organic solvent, mixing them with capsules of a solution of a color former in an organic solvent, and coating the mixed capsules onto a support is adopted conveniently.

In any of the above-mentioned methods, colors excellent in fastness and free of discoloration can be obtained when the color-forming composition is contacted with a color developer.

As is apparent from the foregoing explanation, the critical feature of this invention resides in the fact that the fastness of colors formed by the contact reaction between the color former and color developer can be improved by the action of the aromatic amine or its derivative.

Accordingly, when this invention is applied to a colorless ink composition, the kind of solvent is not critical and any of the known solvents may be used. Further, in the case of a pressuresensitive recording paper, neither the kind of solvent, capsuleforming method, kind of color developer, coating method, form of the sheet nor other factors are critical in this invention.

These non-critical matters will now be explained by specific instances thereof.

As the solvent, natural and synthetic oils may be used singly or in combination. There may be exemplified cotton seed oil, chlorinated biphenyl, chlorinated terphenyl, alkylated biphenyl, alkylated terphenyl, chlorinated paraffin, chlorinated naphthalene, alkylated naphthalene, kerosene, paraffin and naphthene oil.

As the capsule-forming method, there may be mentioned a method utilizing coacervation of a hydrophilic colloidal sol, such as proposed in U.S. Pat. No. 2,800,457 and U.S. Pat. No. 2,800,458, and an interfacial polymerization method such as disclosed in British Pat. No. 867,797, British Pat. No. 989,264 and British Pat. No. 1,091,076.

Any of the known color developers such as described hereinabove may be used to form colors upon contact with color formers.

As the coating method, there may be mentioned an air knife coating method, a blade coating method, a roll coating method, and the like, and various printing methods may also be adopted.

The kind of the color former to be used is not critical in this invention. Examples of the color former usable in this invention are triarylmethane compounds such as 3,3-bis(p-dimethylaminophenyl)-6-dimethylamino phthalide, i.e., Crystal Violet Lactone (which will be abbreviated as "CVL"), 3,3-bis(p-dimethyl-aminophenyl) phthalide, i.e., malachite green lactone, 3-(p-dimethylaminophenyl)3-(1,2-dimethylindol-3-yl) phthalide, 3-(p-dimethylaminophenyl)-3-(2-methylindol-3-yl) phthalide, 3-(p-dimethylaminophenyl)-3-(2-phenylindol-3-yl) phthalide, 3,3-bis(1,2-dimethylindol-3-yl) -5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide, and 3-p-dimethylaminophenyl-3-(1-methylpyrrol-2-yl)-6-dimethylamino-phthalide; diphenylmethane compounds such as 4,4'-bis-dimethyl-amino-benzhydrine benzyl ether, N-halophenyl-leuco-Auramine and N-2,4,5-trichlorophenyl-leuco-Auramine; xanthene compounds such as rhodamine-B-anilinolactam, rhodamine-(p-nitroanilino) lactam, rhodamine-B-(p-chloroanilino) lactam, 7-dimethylamino-2-methoxyfluoran, 7-diethylamino-2-methoxyfluoran, 7-diethylamino-3-methyoxyfluoran, 7-diethylamino-3-chlorofluoran, 7-diethylamino-3-chloro-2-methylfluoran, 7-diethylamino-2,3-dimethylfluoran, 7-diethylamino(3-acetylmethylamino) fluoran, 7-diethylamino-(3-methylamino) fluoran, 3,7-diethylaminofluoran, 7-diethylamino-3-(dibenzyl-amino) fluoran, 7-diethylamino-3-(methylbenzylamino)fluoran, 7-diethylamino-3-(chloroethyl-methylamino) fluoran and 7-diethylamino-3-(diethylamino) fluoran; thiazine compounds such as benzoyl leucomethylene blue, and p-nitrobenzyl leucomethylene blue; and spiropyran compounds such as 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)-spiropyran and 3-propyl-spirodibenzopyran.

This invention will now be detailed by referring to examples, but this invention is not to be limited at all by these examples.

The color developer sheet used in these examples for confirming the effect of improving the color fastness was prepared in the following manner:

One hundred parts of acid clay treated with sulfuric acid was dispersed in 280 parts of water containing 6 parts of a 40% aqueous solution of caustic soda by means of a homogenizer, and the dispersion was incorporated with 50 parts of a 10% aqueous solution of a sodium salt of casein and 30 parts of a styrene-butadidene latex ("Dow Latex 626" manufactured by Dow Chemical Co.). Then the mixture was coated onto raw paper of a unit weight of 50 g/m² by an air knife coating method so that the solid content would be 10 g/m². Then the coated paper was dried to form a color developer sheet.

In the examples "parts" are on the weight basis.

EXAMPLE 1

One part of crystal violet lactone as a color former was dissolved in a mixed oil consisting of 40 parts of chlorinated biphenyl and 10 parts of kerosene, and 1 part of a reaction product of phenyl-betanaphthylamine with acetone (Trade Name: Antigen DA manufactured by Sumitomo Kagaku Kogyo) was dissolved in the above solution as an aromatic amine derivative to form a color-forming oil composition.

The composition was added to an aqueous solution of 10 parts of gum arabic in 60 parts of water maintained at 40°C to form an oil-in-water emulsion containing oil drops of a size of 6 – 10 microns.

An aqueous solution of 10 parts of acid-treated gelatin having an isoelectric point of 7.8 in 80 parts of water maintained at 40°C was added to the above emulsion, and 50% acetic acid was further added thereto with uniform agitation to adjust the pH to 4.2. Then, 250 parts of water maintained at 40°C was added to the mixture to cause coacervation.

At this point a film of a concentrated liquor of gelatin and gum arabic was formed around the oil drops. The agitation was further continued.

In order to gel the so-formed film, the temperature of the mixture was cooled to 10°C and for hardening the film wall 4 parts of 37° formaldehyde was added.

Then, 40 parts of a 10% aqueous solution of carboxymethyl cellulose was added and a 10% aqueous solution of sodium hydroxide was added dropwise to adjust the pH to 9.5 and thus improve the effect of hardening the film wall. Then, the temperature of the solution was elevated to 50°C.

The resulting microcapsular solution was coated on raw paper with a unit weight of 40 g/m² by the air knife coating method in an amount such that the solids content was 6.0 g/m². The coated paper was dried to obtain a capsule sheet.

EXAMPLE 2

Example 1 was repeated by using one part of 3-methyl2,2′-spirobi(benzo [f]- chromene) as the color former instead of one part of Crystal Violet Lactone.

The resulting capsules were coated on raw paper of a unit weight of 40 g/m² by the air knife coating method in an amount such that the solids content was 6.0 g/m², and the coated paper was dried to obtain a capsule sheet.

EXAMPLE 3

Example 1 was repeated by using 1.5 parts of 3-N,N-dimethylamino-6,8-dimethylfluoran as the color former instead of one part of crystal violet lactone.

The resulting microcapsular solution was coated on raw paper with a unit weight of 40 g/m² by the air knife coating method in an amount such that the solids content was 6.0 g/m², and the coated paper was dried to obtain a capsule sheet.

EXAMPLE 4

Example 1 was repeated by using 2.4 parts of 3-N,N-diethylamino-7-(N,N-diethylamino)fluoran as the color former instead of one part of crystal violet lactone.

The resulting microcapsular solution was coated on raw paper with a unit weight of 40 g/m² by the air knife coating method in such an amount that the solids content was 6.0 g/m², and the coated paper was dried to obtain a capsule sheet.

Comparative Examples 1–4

Examples 1–4 were repeated without adding, as the aromatic derivative, the above-mentioned reaction product of phenyl-betanaphthylamine with acetone. The resulting microcapsular solution obtained in each run and being free of the aromatic amine derivative were coated on raw paper having a unit weight of 40 g/m² in an amount such that the solids content was 6.0 g/m². The sheets were dried to obtain capsule sheets. (Comparative Examples 1–4 correspond to Examples 1–4, respectively).

In order to compare the capsule sheets obtained according to this invention with the capsule sheets free of the aromatic amine derivative obtained in the comparative examples, the following comparison test was conducted.

Comparison Test 1

Each of the capsule sheets obtained in Examples 1-4 and Comparative Examples 1–4 was superposed onto a color developer sheet and a color was formed by appying a load of 600 kg/cm² thereto. Then, the assembly was allowed to stand in the dark and the spectroscopic adsorption curve of a fresh color at a wavelength of 700 – 400 mμ was determined (Curve A). Similarly, the spectroscopic adsorption curves were determined after the color so formed was exposed to sun light for 1 hour (Curve B) and for 3 hours (Curve C), respectively. The results are shown on the accompanying drawings.

Figure 2:
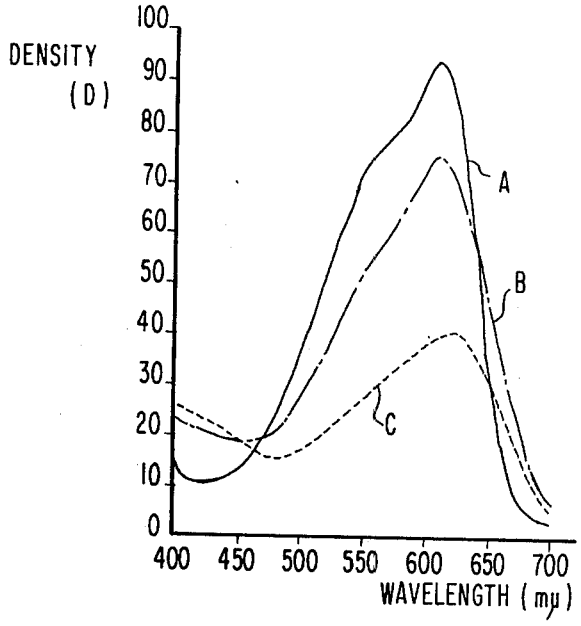
FIGS. 2, 4, 6 and 8 illustrate curves of the colors formed using the capsule sheets obtained in comparative Examples 1, 2, 3 and 4, respectively.
Figure 3:
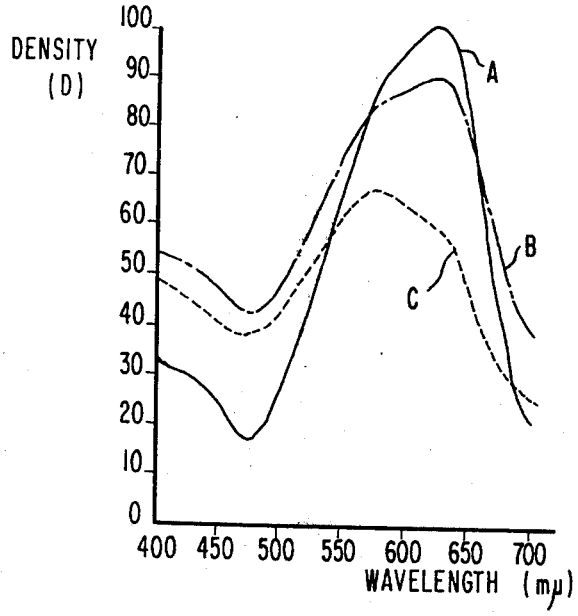
Figure 4:
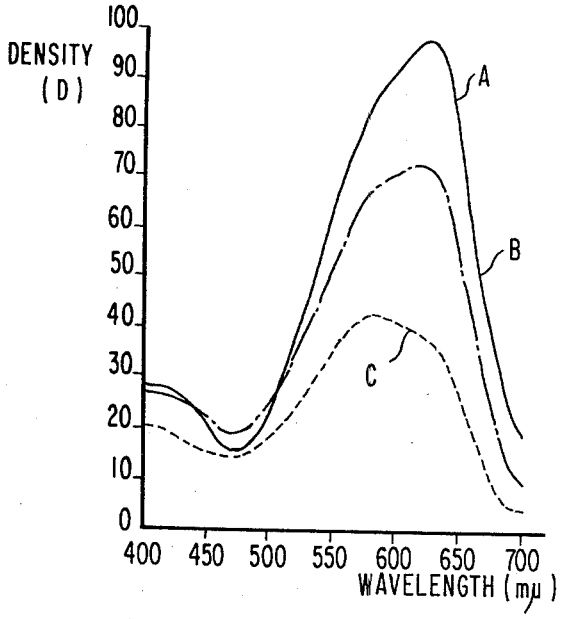
Figure 5:
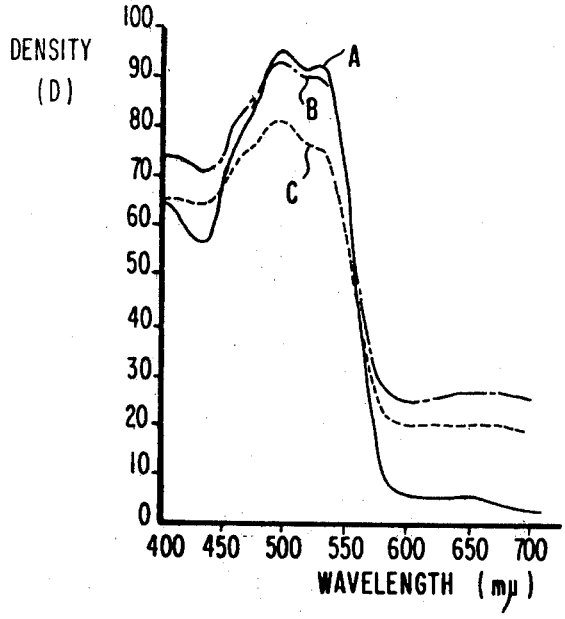
Figure 6:
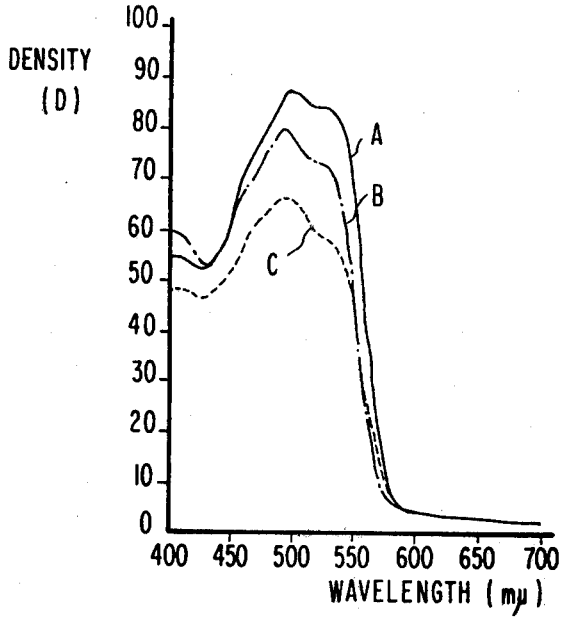
Figure 7:
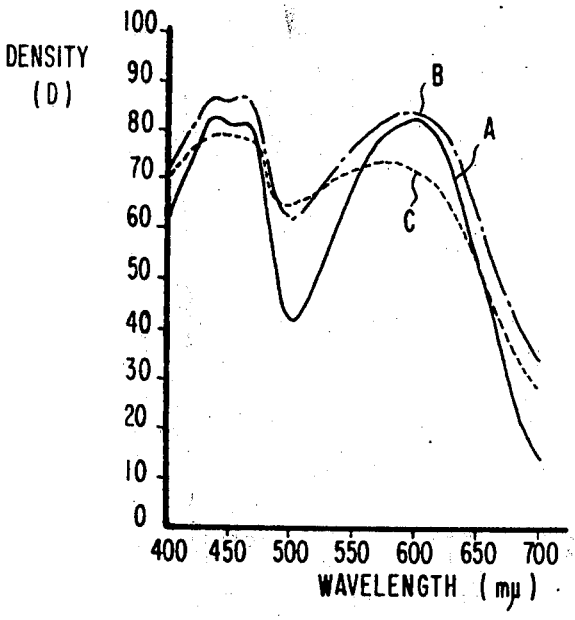
Figure 8:
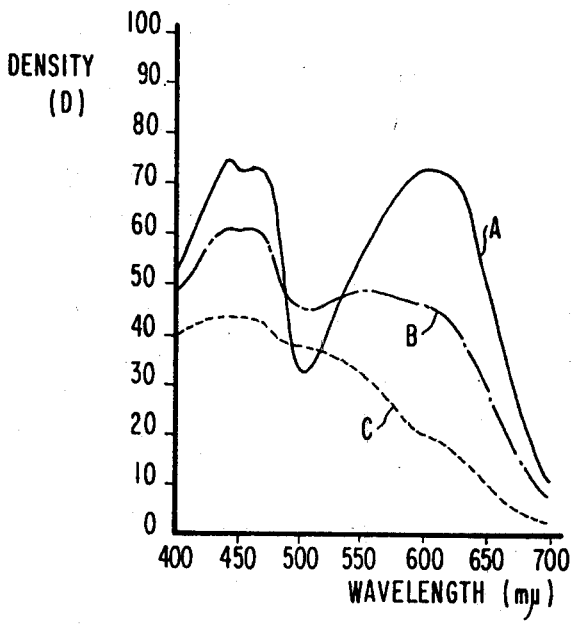

In the drawings, FIGS. 1 and 2 illustrate curves of the colors formed using capsule sheets obtained in Example 1 and Comparative Example 1, respectively; FIGS. 3 and 4 illustrate curves of the colors formed using capsule sheets obtained in Example 2 and Comparative Examples 2, respectively; FIGS. 5 and 6 illustrate curves of the colors formed using capsule sheets obtained in Example 3 and Comparative Example 3, respectively; and FIGS. 7 and 8 illustrate curves of the colors formed using capsule sheets obtained in Example 4 and Comparative Example 4, respectively.

The determination of the spectroscopic adsorption curve was conducted by employing a Beckmann spectrometer, DB type.

The light resistance of the color was determined based on the following equation and the results are shown in Table 1:

$$\text{Light resistance (\%)} = \frac{\text{Density at absorption maximum after light exposure}}{\text{Density of fresh color at absorption maximum}} \times 100$$

Table 1

Photo-resistance (%) of Colors at Absorption Maximum After Exposure to Sun Light

| | One hour's sun light exposure(%) | 3 hours' sun light exposure(%) | Wave-length (mμ) |
|---|---|---|---|
| Example 1 | 92 | 59.6 | 610 |
| Comparative Example 1 | 79.8 | 43.4 | 610 |
| Example 2 | 89.1 | 59.1 | 625 |
| Comparative Example 2 | 74.2 | 38.8 | 625 |
| Example 3 | 98.3 | 85.3 | 500 |
| Comparative Example 3 | 89.8 | 75.8 | 500 |
| Example 4; $\lambda_1$ | 95.0 | 90.0 | 437 |
| Example 4; $\lambda_2$ | 97.8 | 84.8 | 605 |
| Comparative Example 4; $\lambda_1$ | 81.2 | 57.7 | 437 |
| Comparative Example 4; $\lambda_2$ | 57.7 | 28.8 | 605 |

From the spectroscopic absorption curves of Example 4 and Comparative Example 4, the transfer of $\lambda_2$ caused by the sun light exposure was determined. The results are shown in Table 2.

Table 2

Transfer of absorption Maximum $\lambda_2$ by sunlight Exposure in 3-N,N-dimethylamino-7-(N,N-diethylamino) fluoran Color

| | $\lambda_2$ of Fresh Color (mμ) | $\lambda_2$ after one hour's sun light exposure (mμ) | $\lambda_2$ after 3 hour's sunlight exposure (mμ) |
|---|---|---|---|
| Example 4 | 605 | 605 | 570 |
| Comparative Example 4 | 605 | 550 | 510 |

As is apparent from the above test results, the light resistance of the formed color can be extremely improved by the addition of the aromatic amine derivative. Further, from the results shown in Table 2 it is seen that the transfer of the absorption maximum in the color formed by 3-N,N-diethylamino-7-(N,N-diethylamino) fluoran caused by the sun light exposure can be greatly reduced by this invention.

EXAMPLE 5

A color-forming oil composition was prepared based on the following recipe:

| | Parts |
|---|---|
| Chlorinate biphenyl | 40 |

-continued

| | Parts |
|---|---|
| Chlorinated paraffin (chlorination degree of 30%) | 5 |
| Normal paraffin | 5 |
| 3-N,N-biethylamino-7-(N,N-dibenzylamino)fluoran | 2.5 |
| N,N'-di-beta-naphthyl-p-phenylenediamine | 2.0 |

The color former solution was formed into capsules in the same manner as in Example 1, and the resulting capsules were coated on raw paper of a unit weight of 40 g/m² by an air knife coating method in such an amount that the solids content was 6.0 g/m², and the coated paper was dried to obtain a capsule sheet.

Comparative Example 5

A color former solution was prepared based on the same recipe as used in Example 5 except that N,N-di-beta-naphthyl-p-phenylenediamine was not incorporated therein, and microcapsules were formed from the color former solution in the same manner as in Example 1. The resulting micro-capsules were coated on raw paper having a unit weight of 40 g/m² by the air knife coating method in an amount of 6.0 g/m² as solids content, and the coated paper was dried to obtain a capsule paper.

Comparison Test 2

Each of the sheets obtained in Example 5 and Comparative Example 5 was superposed onto a color developer sheet, and a color was formed by applying a load of 600 kg/cm² thereto. The light resistance and the transfer of the absorption maximum wavelength were determined according to methods described in Comparison Test 1. The results are shown in Tables 3 and 4.

Table 3

Light resistance of color formed by 3-N, N-diethylamino 7-(N,N-dibenzylamino) fluoran at absorption Maximum Wavelengths ($\lambda_1$ = 440 mμ :$\lambda_2$ = 610 mμ) after sun light exposure (unit; %)

| | After 1 hour's sun light exposure (%) | After 3 hours' sun light exposure (%) |
|---|---|---|
| Example 5 | | |
| $\lambda_1$ | 92.8 | 89.5 |
| $\lambda_2$ | 91.5 | 86.4 |
| Comparative Example 5 | | |
| $\lambda_1$ | 80.4 | 55.3 |
| $\lambda_2$ | 54.3 | 25.6 |

Table 4

Transfer of absorption maximum wavelength$\lambda_2$ (610 mμ) caused by sunlight exposure in color formed by 3-N,N-diethylamino-7-(N,N-dibenzylamino)fluoran)

| | $\lambda_2$ of Fresh color (mμ) | $\lambda_2$ after 1 hour's sun light exposure (mμ) | $\lambda_2$ after 3 hours' sun light exposure (mμ) |
|---|---|---|---|
| Example 5 | 610 | 605 | 580 |
| Comparative Example 5 | 610 | 560 | 520 |

EXAMPLE 6

A color forming oil composition was prepared based on the following recipe:

| | Parts |
|---|---|
| Dimethylnaphthalene | 30 |
| Normal paraffin | 20 |
| 7-diethylamino-2,3-dimethylfluoran | 2.0 |
| N,N'-diphenyl-p-phenylenediamine | 1.5 |

The resulting color former solution was formed into micro-capsules in the same manner as in Example 1.

The resulting microcapsular solution was coated on raw paper having a unit weight of 40 g/m² by the air knife coating method in an amount of 6.0 g/m² as solids content, and the coated paper was dried to obtain a capsule sheet.

Comparative Example 6

A color former solution was prepared from the same recipe as used in Example 6 except that N,N'-diphenyl-p-phenylene was not incorporated therein, and micro-capsules were formed from this solution in the same manner as in Example 1. The resulting microcapsular solution was coated on raw paper having a unit weight of 40 g/m² by the air knife coating method in an amount of 6.0 g/m² as solids content as the coated paper was dried to obtain a capsule sheet.

Comparison Test 3

Each of the capsule sheets was superposed onto a color developer sheet and a color was formed by applying a load of 600 kg/cm² thereto. The light resistance was determined according to the method described in Comparison Test 1. The results are shown in Table 5.

Table 5

| Light resistance of color formed by 7-Diethylamino-2,3-dimethylfluoran at absorption Maximum Wavelength ($\lambda_1 = 535\mu$) after sun light exposure (unit : %) | After 1 hour's sun light exposure (%) | After 3 hours' sun light exposure (%) |
|---|---|---|
| Example 6 | 97.5 | 86.8 |
| Comparative Example 6 | 87.4 | 70.5 |

EXAMPLE 7

A color-forming solution was prepared by mixing the following components:

| | Parts |
|---|---|
| Chlorinated biphenyl | 45 |
| Isoparaffin | 5 |
| Crystal violet lactone | 1 |
| Benzoyl leucomethylene blue | 0.5 |
| 3-Methyl-2,2'-spiro-bi(benzo[f]chromene) | 1 |
| N,N-Diphenylamine | 1 |

The resulting solution was transferred directly to a color developer sheet by a printing method to form a blue colored image.

Comparative Example 7

A color-forming composition was prepared in the same manner as in Example 7 except that N,N-diphenylamine was not incorporated therein. The resulting solution was transferred to a color developer sheet by the printing method in the same manner as in Example 7 to obtain a blue colored image.

Comparison Test 4

The light resistance of each of the colored images obtained in Example 7 and Comparative Example 7 was determined (wavelength = 610 mμ). The results are shown in Table 6.

Table 6

| Light resistance (%) of Blue-Colored Image | After 1 hour's sun light exposure (%) | After 3 hours' sun light exposure (%) |
|---|---|---|
| Example 7 | 94 | 85 |
| Comparative Example 7 | 85 | 75 |

EXAMPLE 8

A color-forming solution was prepared by mixing the following components:

| | Parts |
|---|---|
| Alkylated terphenyl | 45 |
| Normal paraffin | 5 |
| 2-(N-dichloroethylamino)-6-diethylaminofluoran | 4 |
| Benzoyl leucomethylene blue | 1 |
| N,N'-Diphenylbenzidine | 2 |

The resulting solution was transferred directly to a color developer sheet by the printing method to obtain a colored image of a green color.

Comparative Example 8

The color-forming composition was prepared in the same manner as in Example 8 except that N,N'-diphenyl benzidine was not incorporated therein, and the resulting solution was transferred to a color developer sheet by the printing method in the same manner as in Example 8 to obtain a green colored image.

Comparison Test 5

The light resistance of each of the green-colored images obtained in Example 8 and Comparative Example 8 was determined (wavelength = 600 mμ). The results are shown in Table 7.

Table 7

| Light resistance (%) of Green-Colored image | After 1 hour's sun light exposure (%) | After 3 hours' sun light exposure (%) |
|---|---|---|
| Example 8 | 98 | 92 |
| Comparative Example 8 | 85 | 75 |

What is claimed is:

1. A pressure sensitive copying paper comprising a support having coated thereon a layer of a color-forming composition consisting essentially of leuco dye color former, an aromatic secondary amine selected from the group consisting of N,N'-diphenyl-p-phenylenediamine, N-phenyl-N'-cyclohexyl-p-phenylenediamine, N-phenyl-N'-isopropyl-p-phenylenediamine, N,N'-disec-butyl-p-phenylenediamine, N,N'-di-beta-naphthyl-p-phenylenediamine, N,N'-bis(1,4-dimethylpentyl)-p-phenylenediamine, N,N'-bis(1-ethyl-3-methylpentyl)-p-phenylenediamine, N-(1-methylpropyl)-N'-phenyl-p-phenylenediamine, N,N'-diphenylamine, p-isopropoxy-di-phenylamine, phenylalpha-naphthylamine, phenyl-beta-naphthylamine, a reaction product of acetone with phenyl-beta-naphthylamine, N,N'-diphenylbenzidine, p-methoxy-acetoanilide, hydrazobenzene and N-phenyl-m-anisidine, or derivative thereof, to improve fastness and discoloration resistance of said leuco dye, and an organic solvent, said leuco dye being capable of forming a color when contacted with a color developer selected from the group consisting of a clay, an organic acid and a phenol resin, and a layer of said color developer on the same or a different support.

2. The pressure-sensitive copying paper of claim 1 wherein said color-forming composition is microencapsulated.

3. The pressure-sensitive copying paper of claim 1 wherein said leuco dye and solvent are microencapsulated in one microcapsule, and said amine and solvent are microencapsulated in another microcapsule.

4. The pressure sensitive copying paper of claim 1 wherein the amount of the aromatic amine or aromatic amine derivative is 50–200% by weight, based on the weight of the leuco dye.

5. The pressure sensitive copying paper of claim 1 wherein said clay mineral is a member selected from the group consisting of acid clay, activated clay, attapulgite, zeolite and bentonite.

6. The pressure sensitive copying paper of claim 1 wherein said organic acid is selected from the group consisting of tannic acid or gallic acid.

* * * * *